United States Patent [19]

Stuchberry

[11] 3,968,572

[45] July 13, 1976

[54] CONDITIONING DRUM FOR USE IN HOT WATER SEPARATION OF BITUMEN FROM MINED TAR SANDS

[75] Inventor: Frederick C. Stuchberry, Calgary, Canada

[73] Assignee: Shell Oil Company, Houston, Tex.

[22] Filed: Apr. 3, 1975

[21] Appl. No.: 564,959

[52] U.S. Cl. ..... 34/134; 34/135; 34/138; 209/11; 214/18 K

[51] Int. Cl.[2] ..... F26B 11/02

[58] Field of Search ..... 214/18 K; 209/11, 284, 209/288; 34/132, 133, 134, 135, 138, 232, 36, 37; 261/83, 94

[56] References Cited

UNITED STATES PATENTS

| | | | |
|---|---|---|---|
| 506,916 | 10/1893 | DeKinder et al. | 34/138 |
| 3,073,449 | 1/1963 | Johanningmeier | 209/11 |
| 3,245,154 | 4/1966 | Bojner et al. | 34/135 |
| 3,509,641 | 5/1970 | Smith et al. | 34/134 |
| 3,742,613 | 7/1973 | Gimborn | 34/138 |

*Primary Examiner*—John J. Camby
*Assistant Examiner*—L. I. Schwartz
*Attorney, Agent, or Firm*—Albert A. Jecminek

[57] ABSTRACT

A rotating drum type muller is described for initial conditioning of mined tar sands by the hot water method for separation of bitumen from the sands wherein ablation of mined tar sand lumps into pulp is effected through the addition of hot water, steam and caustic. This conditioning drum comprises a horizontally disposed cylindrical drum of a length to diameter ratio of about 1:1 or less, rotatable around its longitudinal axis and having axial openings at its inlet end for introduction of mined tar sand lumps, water and caustic and at its outlet end for rejection of oversize and discharge of mulled tar sands pulp, said axial opening at its outlet end being divided by a coaxial grate member, extending along the longitudinal axis of the drum, into an outer annular opening for discharge of tar sands pulp and an inner axial opening for rejection of oversize, said grate size being sufficient to allow ready passage of tar sands pulp into a discharge passageway defined by the outer annular opening while retaining the oversize; and a plurality of downwardly projecting steam conduits affixed to a stationary steam header extending substantially over the length of the drum interior along the longitudinal axis of the drum, said conduits being perforated for injecting steam into said cylindrical drum.

14 Claims, 2 Drawing Figures

CONDITIONING DRUM FOR USE IN HOT WATER SEPARATION OF BITUMEN FROM MINED TAR SANDS

BACKGROUND OF THE INVENTION

This invention relates to a rotary drum apparatus for initial conditioning of mined tar sand in the hot water method for separation of bitumen from the tar sands. More particularly, this invention is directed to a conditioning drum wherein mined tar sand lumps are mulled and pulped with the addition of water, steam and caustic to produce an aqueous slurry of bitumen and mineral which is uniquely suited for processing in the conventional hot water separation process while at the same time accomplishing a major portion of the oversize screening and rejection in the conditioning drum itself.

In the conventional hot water separation process for surface recovery of bitumen from mined tar sand deposits, the raw tar sand, i.e., tar sand and unwanted mineral rock from the mining operation, is jetted with steam and mulled with caustic soda and a minor amount of hot water in a slowly rotating conditioning drum. During this initial conditioning operation large rocks, typically ¾ inch in diameter or larger, are rejected and the solid tar sand is converted to an aqueous based pulp containing a bitumen component in the form of a froth or emulsion with water, clay and slit fines at least partially entrained in the froth and sand particles. After conditioning, this pulp, which typically has a water content of 20–30 weight percent and a temperature of 180°–190°F, is mixed with additional water and transferred to separation cells. There an oil-rich emulsion of bitumen, fine material and water rises to the surface as a froth which is withdrawn for further treatment. Sand settles to the bottom and is pumped as a slurry to a tailings disposal area. Between the bitumen froth at the top of the separation cell and the coarse material on the bottom is a body of "middlings" containing some mineral and bitumen.

A stream of middlings is withdrawn from the center of the separation cell. Part of the stream is recycled to dilute the screened pulp before it passes into the separation cells. The rest of the middlings stream is processed through air flotation scavenging cells. Froth from the scavenging cells is passed to a froth settler. Tailings from the froth settler are recycled to extinction through the scavenger cells. Settled froth from the froth settler is combined with separation cell froth for further treatment.

In the past phase of the conventional hot water separation process, the combined froth is diluted with naphtha to reduce viscosity and density and is then centrifuged to remove mineral particles and water. Sludge from the centrifuges is further processed to recover naphtha and passed to a tailings disposal area. Diluted bitumen is separated from the naphtha diluent by distillation and passed as bitumen product to process facilities.

While the hot water separation process described in general terms above is felt by many to be the most practical, and therefore the optimum way of recovering the bitumen from the tar sands, the process is not devoid of problems. One of the primary problem areas derives from the nature of the tar sands pulp produced in initial conditioning step of the process. Conventional conditioning drums such as those described in U.S. Pat.

No. 3,509,641 to Smith et al are typically axial open-ended, horizontal drums having a length to diameter ratio of about 3:1 which are further equipped with steam sparges that extend longitudinally along the interior drum wall. In operation of the conditioning drum water, caustic and mined tar sands are introduced at one open end of the drum, the drum is slowly rotated to mull and pulp the tar sands, steam being injected only through those sparges which are immersed in the pulp, and the conditioned pump along with the oversize is passed out of the other axial end of the drum on to one or more large screening devices which remove the oversize from the pulp. While this operation produces a thoroughly mulled tar sands pulp, it also forces a substantial portion of fines into the bitumen phase which in turn is present as a rather stable emulsion or froth. This stable bitumen-water emulsion or froth of high fines content increases the difficulty in obtaining an adequate separation in the subsequent processing of the pulp in the separation cells thereby reducing the recovery of bitumen in the separation cells. Further, since little or no separation of oversize from the pulp is effected in the conditioning drum itself, very large and difficult to operate screens are needed to segregate the oversize from the conditioned pulp prior to its introduction into the separation cells.

The instant invention offers a solution to the aforementioned problems while at the same time providing a tar sands pulp which is sufficiently mulled to be processed in any conventional separation cell operation.

SUMMARY OF THE INVENTION

The present invention therefore relates to a tar sands conditioning drum for mulling of mined tar sand into pulp through the addition of hot water, steam and caustic which comprises; a horizontally disposed cylindrical drum of a length to diameter ratio of about 1:1 or less, rotatable around its longitudinal axis and having a. an axial opening at one end for introduction of mined tar sand, water and caustic;

b. a second axial opening at the other end for rejection of oversize and discharge of mulled tar sands pulp, said second axial opening being divided by a coaxial grate member, extending along the longitudinal axis of the drum, into an outer annular opening for discharge of tar sands pulp and an inner axial opening for rejection of oversize, said grate size being sufficient to allow ready passage of tar sands pulp into a discharge passageway defined by said outer annular opening while retaining the oversize, and c. an externally supported stationary steam header extending into and substantially over the length of the drum interior along the longitudinal axis of the drum having affixed thereto, in fluid communication, a plurality of steam conduits which project downwardly from the steam header to a point above the lower interior surface of the drum, said steam conduits being positioned at spaced intervals along the length of the steam header and perforated for injection of steam into said cylindrical drum.

With the conditioning drum of the instant invention, having the critical length to diameter ratio described, the bitumen-water emulsion or froth formed early in the conditioning process has a shorter path to travel to discharge and as a consequence the amount of entrained fines is reduced. Also, a coarser bitumen-water emulsion is generated which increases the recovery in the separation cell. Furthermore, since the mulled pulp must first pass through the coaxial grate member prior to discharge out of the outer annulus of the axial discharge opening, a major proportion of the pulp can be screened inside the conditioning drum itself thereby markedly reducing the scale of the screening operation required to remove oversize from the conditioned pulp in prior art processes. Finally, the fact that both oversize and tar sands pulp are discharged from separate annuli forming a common axial opening at one end of the conditioning drum makes for a simple and economic drum construction while at the same time ensuring superior vapor sealing of the conditioning process zone.

DETAILED DESCRIPTION OF THE INVENTION

Figure 1:
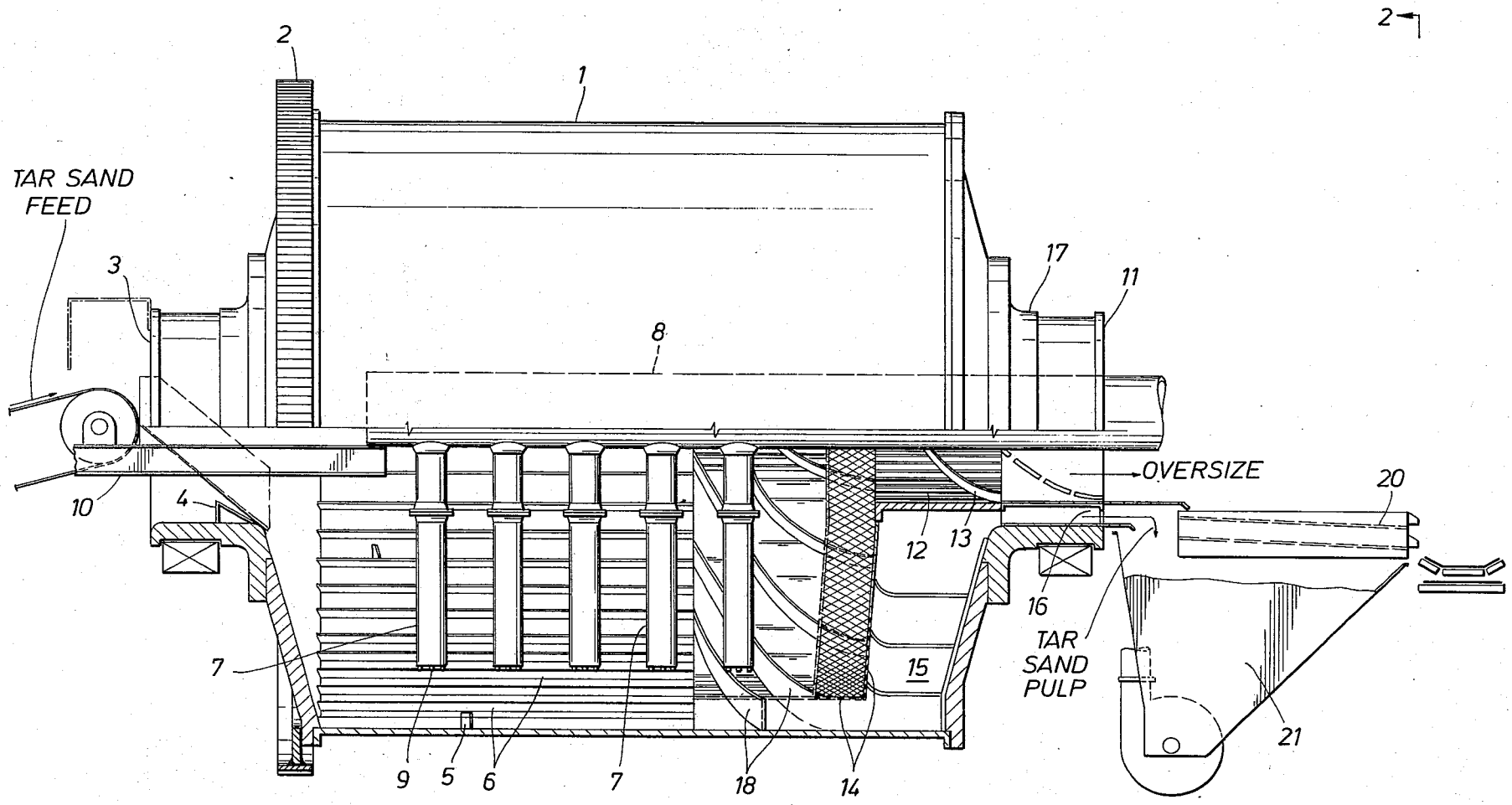
Figure 2:
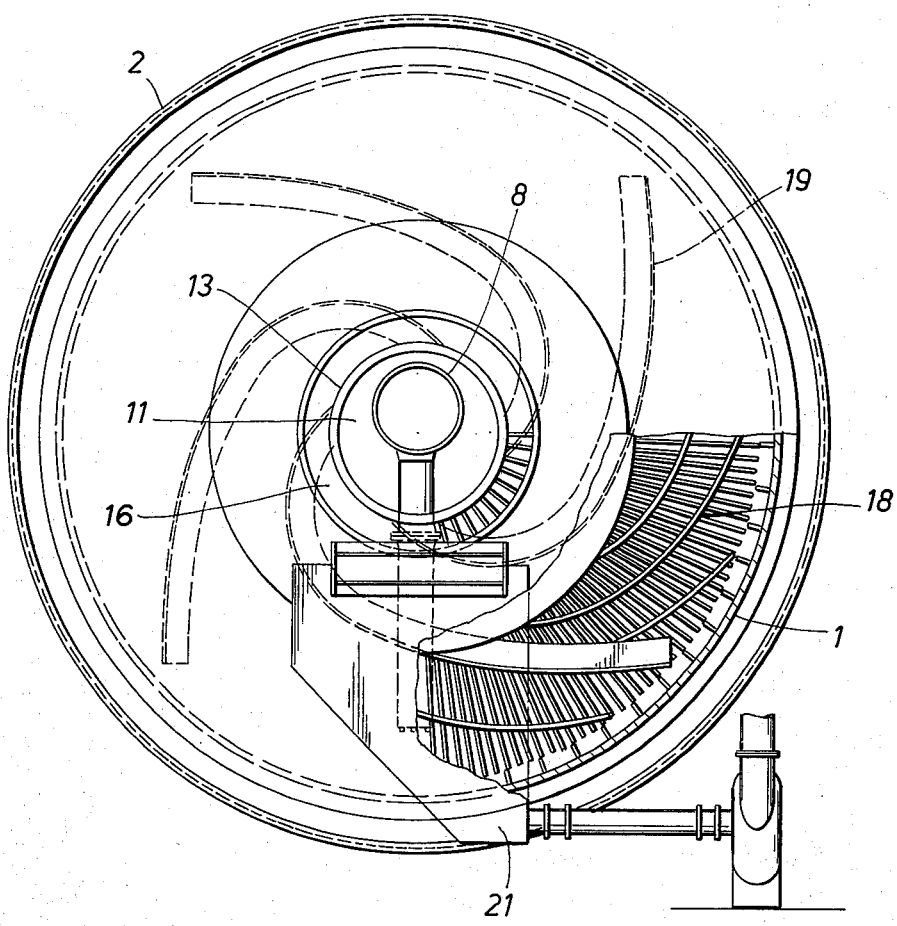

A critical feature of the tar sands conditioning drum of the instant invention is the dimensions of the enclosed cylindrical chamber defined by the inner surfaces of the conditioning drum. According to the invention it is essential that the length to diameter ratio of this cylindrical chamber be about 1:1 or less. In addition to the above-mentioned advantages on fines entrainment and froth stability, the physical mulling of raw tar sands into pulp with the instant apparatus is also improved because more depth is added to the drum which allows larger tar sand lumps to advance more slowly along the perimeter of the drum thus accentuating the mulling action of the conditioning process on those portions of the raw tar sands needing the most comminution. Furthermore, from a practical standpoint, drum operation is also improved because the stationary steam header or conduit pipe utilized to transport steam into the drum in place of the conventional, perforated steam conduits, that extend longitudinally along the interior wall of the drum for injection of steam during the conditioning process, does not need to be nearly as long as the conduits employed in conventional conditioning drums. Thus, it is much easier to ensure that steam reaches the far end of the steam injection conduits with the instant apparatus than with conventional conditioning drums. For optimum operation it is preferred that this length to diameter ratio be no less than 0.5:1 with ratios in the range of 0.75:1 to 1.25:1 being most preferred.

The axial opening at one end of the drum for introduction of the mined tar sand lumps, water and caustic is preferably circular in shape and of restricted size relative to the dimensions of the conditioning drum itself. Typically, the diameter of this axial opening is between 1/6 and ½ of the diameter of the drum. Preferably the diameter is about ⅓ that of the drum diameter. With inlet openings in this size range, the pulp depth in the conditioning operation is maintained at levels which ensure adequate mulling of the raw tar sand. Suitably, this axial opening is equipped with a lip which extends outwardly from the opening coaxial with the longitudinal axis of the drum. The inner surface of this lip is most suitably equipped with a raised blade of spiral shape to aid in advancing the tar sand into the conditioning drum.

As indicated previously, it is essential that the interior of the conditioning drum of the instant invention be equipped with a steam dispensing means comprising a stationary steam header, or main conduit pipe closed at its downstream end, which extends substantially over the length of the drum interior along the longitudinal axis of the drum and a plurality of downwardly projecting steam conduits which are affixed to, and in fluid communication with, the steam header. These steam conduits are spaced at intervals along the length of the steam header and perforated to ensure that intimate contact is established between the steam and the tar sands pulp during the conditioning operation. Preferably, the stationary steam header extends through the inner axial opening for rejection of oversize and terminates only a short distance from the axial tar sands inlet opening thereby facilitating steam transport over, substantially, the entire length of the drum interior. The longitudinal axis of this main steam conduit pipe or header preferably coincides with the longitudinal axis of the drum, however, it may be slightly displaced from this position provided that its location does not interfere with free rotation of the drum. This steam header is suitably maintained in a stationary position relative to the rotating drum by means of one or more external supports of conventional design which are attached to the header at one or more points both inside the conditioning drum, itself, and/or on the portion of the header which extends out of the conditioning drum back towards the steam source. This steam source, in turn, may be a fuel-fired boiler of any conventional design for generating the desired quantity of steam. The perforated, downwardly projecting steam conduits located inside the drum and preferably spaced uniformly along the length of the steam header and are attached to fixed points in the form of openings on the lower periphery of the header by suitable means, e.g., by welds or collars, such that fluid communication between the header and the conduits is established. To facilitate the required intimate contact between the tar sands pulp and the steam, the steam conduits extend downwardly from the steam header into the lower portion of the horizontally disposed drum to a point well below the anticipated tar sands pulp level in the drum, but above the lower internal surface of the drum or any appurtenances thereto. Further, each of the steam conduits is perforated by means of one or more steam ports located on the portion of its circumference and/or base facing the drum bottom which extend beneath the pulp surface to effect direct passage of steam into the body of mulled tar sands pulp contained in the drum when it is in operation. Preferably, at least the base of each steam conduit facing the drum bottom is perforated by means of one or more steam ports because the resultant steam trajectory, i.e., perpendicular to the pulp surface, affords the greatest steam/pulp contact while minimizing the possibility of channeling. Since the plurality of steam conduits utilized to inject steam into the tar sands pulp in the instant conditioning drum are affixed to, and in stationary relationship with, the steam header they are also stationary relative to the rotating action of the drum during the conditioning operation. Thus, the steam dispensing means employed in the instant invention possesses certain operational advantages over conventional steam dispensing means such as that described in U.S. Pat. No. 3,509,641 and U.S. Pat. No. 3,262,218, wherein perforated steam conduits are affixed to and rotate with the drum periphery, since the steam conduits do not rotate and the need for elaborate and difficult to maintain steam valving devices whereby steam can be conducted to only those conduits below the pulp surface is avoided.

To aid in breaking up tar sand lumps the interior of the drum is equipped with a plurality of raised baffles preferably having an L-shaped configuration with one leg of the L being affixed to the drum periphery and extending perpendicularly from the drum surface along the radius of the drum and the other leg of the L being essentially parallel with the drum surface. These raised baffles which function to lift the tar sands pulp are most preferably held in stationary position relative to the drum periphery by appropriate supporting means anchored to the drum surface. Additionally, the interior peripheral surface of the conditioning drum is also equipped with internal tar sands advancing paddles in the form of raised blades which are pitched to move the tar sands through the drum. The residence time in the drum can be controlled by spacing alteration or pitch variation of these paddles. The interior of the drum is also provided with a basket-type rock ejector for discarding very large rocks and lumps of tar sand which pass through the drum without disintegrating.

Another critical feature of the tar sands conditioning drum according to the invention is the manner in which the axial opening at the discharge end of the drum is subdivided by means of a coaxial grate member into an outer annular opening for discharge of tar sands pulp and an inner axial opening for rejection of oversize. The axial discharge opening containing these separate annuli for rejection of oversize and discharge of tar sands pulp is suitably of substantially the same dimension relative to the overall conditioning drum diameter as the axial opening at the opposite drum end for introduction of tar sands feed. According to the invention, this axial opening is divided by a coaxial grate member which extends longitudinally along the drum axis. Suitably, this coaxial grate member extends both in an outward direction into the discharge passageway bounded by an axial opening defining trunnion affixed to the discharge end of the drum, and inwardly for a small distance into the drum interior as defined by the shell of the drum, with the internal base surface of the drum at its discharge end extending radially from the circular structure defined by the inner end of the coaxial grate member. For the purpose of this application the word "shell" shall mean the external base and external peripheral surface of the drum excluding appurtenances thereto. With this drum construction, the combined tar sands pulp and oversize and pushed upwardly by rotating action of the drum onto the outlet surface defined by the coaxial grate member, the tar sands pulp passes through the grate surface into the outer annular discharge opening and the oversize is retained on the grate surface for rejection out of the inner axial opening bounded by this grate. Furthermore, depending on the distance at which the coaxial grate member is displaced into the drum interior, as defined by its outer shell, the volume of the outer annular opening for pulp discharge is increased by a grated tar sands pulp discharge passageway or reservoir bounded by the coaxial grate member and the internal and external base surfaces of the discharge end of the drum. This reservoir, which functions to receive tar sands pulp passing through the coaxial grate member and thereby minimize the effects of upsets and surging in the drum, preferably also extends for a small distance along the drum periphery by inward displacement of the inner peripheral surface of the drum adjacent to, and in contact with, the drum base surface at its discharge end to form a peripheral cavity bounded by the outer peripheral surface or peripheral portion of the shell of the drum, in fluid communication with the outer annular discharge opening. The coaxial grate member, itself, is suitably a series of parallel bars extending longitudinally along the drum axis and is sized such that the openings in the grid are sufficient to allow ready passage of the tar sands pulp while retaining the oversize, i.e., rocks and tar sand lumps ** inch in diameter and over. Accordingly, it is preferred that the smallest dimension of the openings in the grate member be about ½ inch and preferably from ½ inch to ¾ inch. The longitudinal dimension of this grate member will in part depend on the rate at which tar sand is to be processed through the conditioning drum and the rate at which the drum is rotated during processing. Typically, in cases where the drum is rotated at conventional rates - i.e., 10–20% of critical speed where $$\text{critical speed} = \frac{54.18}{S^{1/2}},$$

$S$ being drum radius (ft) -, the longitudinal dimension of the peripheral grate member will be from about 5 to 15% of the length of the conditioning drum taken along its axis. To facilitate rejection of oversize out the inner axial opening, the surface of the coaxial grate member facing the drum axis is preferably overlaid with an advancing scroll in the form of a raised spiral-shaped blade which may be continuous, slotted or a combination of both.

In a preferred embodiment of the invention, the axial discharge of tar sands pulp is promoted by a supplemental grate discharge, usually in the form of a screen of appropriate sieve size, which makes up the peripheral internal surface of the drum for a given portion of the drum, usually 30% or less of the peripheral surface area of the drum, adjacent to the discharge end of the drum. More preferably, this supplemental grate discharge member or screen also angles upward at the discharge end of the cylindrical conditioning drum to form a portion, e.g., 50%, of the terminating internal base surface of this end of the drum. In this preferred embodiment, the tar sands pulp passing through the grate member delimiting the axial opening for discharge of oversize and the supplemental grate member along the periphery and base of the drum empties into the aforementioned tar sands pulp reservoir and outer annular opening which together form a common passageway for axial discharge of pulp.

The invention will now be further elucidated with reference to the drawings.

FIG. I is a side view of a conditioning drum according to the invention taken in partial cross-section.

FIG. II is a partial sectional view of the conditioning drum from line 2—2 of FIG. I.

Referring to FIG. I, the conditioning drum according to the invention is designated generally as 1. This drum is rotatable on its longitudinal axis and as such is equipped with a peripheral gear 2, which is operatively connected to a mechanical power source (not shown) to facilitate its rotation during the tar sands conditioning process. The axial opening for introduction of mined tar sand, water and caustic is indicated generally at 3, said opening being equipped with feed flights 4 to aid in moving the tar sands into the body of the drum. Affixed to the interior peripheral surface of the drum are a plurality of pitched advancing paddles 5 for moving the tar sands pulp through the drum during the conditioning process. The interior peripheral surface of the drum is further provided with raised baffles 6 which lift and agitate the tar sands pulp. A plurality of steam conduits, 7, affixed to and in fluid communication with a stationary steam header, 8, project downwardly at uniform intervals from the header disposed along longitudinal axis of the drum into the lower portion of the drum interior. These steam conduits which terminate at a point below the anticipated tar sands pulp level in the drum are perforated with steam ports, 9, at their base surfaces facing the lower internal surface of the drum to provide intimate contact between the tar sands and the steam. The stationary header is externally supported and cantilevered into the drum through trunnion, 16, and supported internally by structure, 10. The header is closed off at its terminating base facing the tar sands inlet opening, 3, and connected by appropriate valving (not shown) at its opposite end to a steam source such as a boiler (not shown). The trunnion, 17, forms the common axial opening for discharge of tar sands pulp and rejection of oversize, indicated generally at 11. This axial opening is divided by a grate member, 12, in the form of a bar grid which extends longitudinally along the axis of the drum into the trunnion, 17. The grate member is equipped with an advancing scroll, 13, on its inner peripheral surface to aid in axial discharge of the oversize. The tar sands pulp which is discharged axially through the grate member, 12, and the supplemental grate member, 14, forming a portion of the internal peripheral surface and base end of the drum, passes through the grated bar sands pulp reservoir, 15, bounded by the internal and external base and peripheral surfaces of the drum and the annular discharge opening, 16, bounded by the trunnion and coaxial grate member, which taken together form a common passageway for axial discharge of tar sands pulp. Also shown in this figure are the pulp lifter slots, 18, detailed below, and downstream oversize vibrating screens, 20, and pulp collection tank, 21, with associated separation cell feed pump.

In FIG. II the pulp lifter slots are indicated generally at 18. These pulp lifter slots, which are positioned in a decreasing spiral from the shell to annular opening, 16, with rotation of the drum move material from the drum's periphery to the annular opening, 16. Also shown in this figure are the basket-type rock ejectors, 19, for rejection of large rocks and tar sand lumps out the axial oversize discharge opening.

What is claimed is:

1. A tar sands conditioning drum for mulling of mined tar sand lumps into pulp through the addition of hot water, steam and caustic which comprises; a horizontally disposed cylindrical drum of a length to diameter ratio of between 0.5:1 and 1.25:1, rotatable around its longitudinal axis and having a. an axial opening at one end for introduction of mined tar sand, water and caustic;

b. a second axial opening at the other end for rejection of oversize and discharge of mulled tar sands pulp, said second axial opening being divided by a coaxial grate member, extending along the longitudinal axis of the drum, into an outer annular opening for discharge of tar sands pulp and an inner axial opening for rejection of oversize, said grate size being sufficient to allow ready passage of tar sands pulp into a discharge passageway defined by said outer annular opening while retaining the oversize; and c. an externally supported stationary steam header extending into and substantially over the length of the drum interior along the longitudinal axis of the drum having affixed thereto, in fluid communication, a plurality of steam conduits which project downwardly from the steam header to a point above the lower interior surface of the drum, said steam conduits being positioned at spaced intervals along the length of the steam header and perforated for injection of steam into said cylindrical drum.

2. The tar sands conditioning drum according to claim 1, wherein the length to diameter ratio ranges from 0.75:1 to 1.25:1.

3. The tar sands conditioning drum according to claim 2, wherein the downwardly projecting steam conduits affixed to the steam header are spaced uniformly along the length of the header inside the drum and extend downwardly from the steam header into the lower portion of the drum to a point below the anticipated tar sands pulp level in the drum thereby facilitating injection of steam directly into the tar sands pulp.

4. The tar sands conditioning drum according to claim 3, wherein each downwardly projecting steam conduit is perforated with one or more steam ports located on the portion of its circumference and/or base surface facing the drum bottom which extend beneath the anticipated tar sands pulp surface.

5. The tar sands conditioning drum according to claim 4, wherein the base of each downwardly projecting steam conduit facing the drum bottom is perforated by means of one or more steam ports.

6. The tar sands conditioning drum according to claim 3, wherein the axial opening at one drum end for introduction of mined tar sands, water and caustic is sized to have a diameter between about 1/16 and ½ of the diameter of the conditioning drum.

7. The tar sands conditioning drum according to claim 6, wherein the second axial opening for rejection of oversize and discharge of mulled tar sands pulp is of substantially the same dimension relative to the overall conditioning drum diameter as the axial opening at the opposite drum end for introduction of tar sands feed.

8. The tar sands conditioning drum according to claim 7, wherein the coaxial grate member dividing the second axial opening extends both in an outward direction into the drum discharge passageway bounded by an axial opening defining trunnion, affixed to the discharge end of the drum, and inwardly into the drum interior as defined by the shell or external surface of the drum, with the internal base surface of the drum at its discharge end extending radially from the circular structure defined by the end of the coaxial grate member whereby mulled tar sands pulp and oversize pass first over the coaxial grate member on discharge from the drum.

9. The tar sands conditioning drum according to claim 8, wherein the peripheral grate member is sized such that the smallest dimension of the openings in the grate member are about ½ inch.

10. The tar sands conditioning drum according to claim 9, wherein the longitudinal dimension of the grate member is from about 5 to 15% of the length of the conditioning drum taken along its axis.

11. The tar sands conditioning drum according to claim 10, wherein the volume of the outer annular opening for tar sands pulp discharge is increased by a tar sands pulp passageway or reservoir in fluid communication with the outer annular opening which is bounded by the inwardly projecting portion of the coaxial grate member and the internal and external base surfaces of the discharge end of the drum.

12. The tar sands conditioning drum according to claim 11, wherein the tar sands pulp passageway or reservoir is also extended along the drum periphery by inward displacement of the inner peripheral surface of the drum adjacent to, ad in contact with the inner drum base surface at the drum discharge end.

13. The tar sands conditioning drum according to claim 10, wherein the coaxial grate member is a series of parallel bars extending longitudinally along the drum axis.

14. The tar sands conditioning drum according to claim 12, wherein the axial discharge of tar sands pulp is promoted by a supplemental grate discharge which makes up the peripheral internal surface of the drum adjacent to the discharge end of the drum and a portion of the terminating internal base surface of the discharge end of the drum, said supplemental grate discharge and said peripheral grate member emptying into the tar sands pulp passageway or reservoir in fluid communication with the outer annular discharge opening.

* * * * *